US008687468B2

(12) United States Patent
Nagatake et al.

(10) Patent No.: US 8,687,468 B2
(45) Date of Patent: Apr. 1, 2014

(54) TRICK-ACTION TYPE CLOCK

(75) Inventors: Kenju Nagatake, Saitama (JP); Koji Murasugi, Saitama (JP)

(73) Assignee: Rhythm Watch Co., Ltd., Saitama (JP)

( * ) Notice: Subject to any disclaimer, the term of this patent is extended or adjusted under 35 U.S.C. 154(b) by 116 days.

(21) Appl. No.: 13/347,955

(22) Filed: Jan. 11, 2012

(65) Prior Publication Data

US 2013/0028057 A1 Jan. 31, 2013

(30) Foreign Application Priority Data

Jul. 26, 2011 (JP) ..... 2011-162927

(51) Int. Cl.
*G04B 19/00* (2006.01)

(52) U.S. Cl.
USPC ..... 368/233; 368/229

(58) Field of Classification Search
USPC ..... 368/232–237, 229
See application file for complete search history.

(56) References Cited

U.S. PATENT DOCUMENTS

| | | | | |
|---|---|---|---|---|
| 4,428,682 | A * | 1/1984 | Winter | 368/238 |
| 5,161,130 | A * | 11/1992 | Sato et al. | 368/228 |
| 7,061,833 | B2 * | 6/2006 | Dierenbach | 368/76 |
| 7,559,688 | B2 * | 7/2009 | Robert-Nicoud et al. | 368/294 |
| 7,864,742 | B2 * | 1/2011 | Bennett | 370/338 |
| 2012/0287762 | A1 * | 11/2012 | Mintiens | 368/233 |

FOREIGN PATENT DOCUMENTS

| | | |
|---|---|---|
| JP | 2001-153971 A | 6/2001 |
| JP | 2004-028972 A | 1/2004 |
| JP | 2004-037319 A | 2/2004 |

* cited by examiner

*Primary Examiner* — Sean Kayes
(74) *Attorney, Agent, or Firm* — Kubotera & Associates, LLC

(57) ABSTRACT

In a trick-action type clock, a part of an hour plate rotates along a plane parallel to a clock support plate. The trick-action type clock includes a first hour plate portion which is fixed to the clock support plate and has a circular shape, and a second hour plate portion which is rotated by a driving motor. The first hour plate portion includes an indicator needle shaft insertion portion which is provided at a position remote from a center of the first hour plate portion so as to insert an indicator needle shaft 101 therethrough. The second hour plate portion includes a circular notched hole which has a rotation center coincides with the center of the first hour plate portion with a circular shape and has the same shape as that of the first hour plate portion.

7 Claims, 9 Drawing Sheets

TRICK-ACTION TYPE CLOCK

BACKGROUND OF THE INVENTION AND RELATED ART STATEMENT

The present invention relates to a trick-action type clock with a structure in which an hour plate rotates.

As a conventional trick-action type clock, a clock with a rotatable hour plate is known. For this kind of trick-action type clock, for example, there is proposed a clock in which one assembled hour plate is divided into a plurality of plates every hour on the hour so as to rotate about a predetermined axis, or a clock in which a plurality of hour plates overlapping each other rotates about each axis every hour on the hour (refer to Patent Documents 1 to 3).

In the trick-action type clock with the rotatable hour plate, generally, a driving mechanism is disposed between the divided hour plates so as to overlap each other and a linkage mechanism is provided between the divided hour plates so as to link them to each other.

Patent Document 1: Japanese Patent Publication No. 2001-153971

Patent Document 2: Japanese Patent Publication No. 2004-028972

Patent Document 3: Japanese Patent Publication No. 2004-037319

In the above described trick-action type clock with the rotatable hour plate, generally, an indicator needle shaft penetrating the hour plates is fixed, and the driving mechanisms and the linkage mechanisms are respectively provided so as to avoid the indicator needle shaft.

In particular, since the driving mechanism is disposed between the divided hour plates so as to overlap each other, the longitudinal width of the periphery of the hour plate increases in proportion to the number of the divided hour plates, and the linkage mechanism between the divided hour plates becomes complex in many respects, which inevitably causes an increase in number of components. Furthermore, since the hour plate rotates, a rotary shaft serving as a rotation center thereof is needed. However, a problem arises in that a layout of the rotation center of the hour plate is limited.

SUMMARY OF THE INVENTION

The invention proposes a trick-action type clock in which an indicator needle shaft is fixed, the trick-action type clock being capable of saving power of a mechanism with a simpler configuration and having a good appearance and an improved trick-action effect through a reasonable arrangement of a plurality of hour plates to be used.

According to a first aspect of the invention, with reference numerals used in the embodiment, a trick-action type clock, in which a part of an hour plate rotates along a plane parallel to a clock support plate 100, includes a first hour plate portion 1 which is fixed to the clock support plate 100 and has a circular shape; and a second hour plate portion 2 which is rotated by a driving motor M. The first hour plate portion 1 includes an indicator needle shaft insertion portion 1*a* which is provided at a position remote from the center s of the first hour plate portion 1 so as to insert an indicator needle shaft 101 therethrough. The second hour plate portion 2 includes a circular notched hole 2*a* which has a rotation center at the position coincides with the center s of the first hour plate portion 1 and in the circular shape in the same shape as that of the first hour plate portion 1.

According to a second aspect of the invention, the first hour portion 1*a* position provided with the indicator needle shaft insertion portion 1*a* is provided with a ring portion 1*b* formed in a ring shape. A third hour plate portion 3, which is rotatably provided with respect to the ring portion, is mounted on the inside of the ring portion 1*b*. The third hour plate portion 3 has its rotation center at the same position (center S) as that of the rotation center of the second hour plate portion 2, and the third hour plate portion rotates coupled with the rotation of the second hour plate portion 2.

According to a third aspect of the invention, the clock support plate 100 at a position provided with the first hour plate portion 1 is provided with a first linkage gear plate 10 having a rotation center coincides with the center s of the first hour plate portion 1 and a second linkage gear plate 20 coaxial with the first linkage gear plate 10 respectively rotatably. The first linkage gear plate 10 is rotated by the driving motor M. A short cylindrical portion 11 is formed at the center of the first linkage gear plate. The outside of the short cylindrical portion 11 is provided with a disk-like flange portion 12. The inner periphery of the short cylindrical portion 11 is provided with an inner gear 13. The outer periphery of the flange portion 12 is provided with an external gear 14 meshing with and coupled to the driving motor M. The outer periphery of the second linkage gear plate 20 is provided with an external gear 21, and the center thereof is provided with a fixed portion 22 fixing the third hour plate portion 3 to be rotatable together. A linkage gear 4, which meshes with and is linked to the inner gear 13 of the short cylindrical portion 11 and the external gear 21 of the second linkage gear plate 20, is rotatably provided on the clock support plate 100. The second hour plate portion 2 is fixed to the first linkage gear plate 10 rotatably together. The first linkage gear plate 10 rotates by the rotation of the driving motor M thereby the second hour plate portion 2 rotates, and the linkage gear 4 meshing with the inner gear 13 of the first linkage gear plate 10 and the second linkage gear plate 20 meshing therewith rotate so that the third hour plate portion 3 rotates.

In the first aspect of the invention, for example, in the case where the trick action starts on the hour so that the second hour plate portion 2 rotates, the second hour plate portion 2 rotates about a position different from the rotation center of the indicator needle shaft 101, the rotation thereof becomes an eccentric rotation with respect to the indicator needle shaft 101, and the trick-action effect may be further exhibited. Further, since the second hour plate portion 2 includes the circular notched hole 2*a* having a rotation center provided at a position coincides with the center s of the first hour plate portion 1 and in a circular shape the same shape as that of the first hour plate portion 1, the center of the circular shape of the notched hole 2*a* coincides with the center s of the first hour plate portion 1. As a result, even when the second hour plate portion 2 rotates, the first hour plate portion 1 is positioned so as to correspond to the notched hole 2*a* of the second hour plate portion 2 at all times. Then, even when the second hour plate portion 2 is provided at the front side of the first hour plate portion 1, the first hour plate portion 1 may be visible through the notched hole 2*a* of the second hour plate portion 2. Accordingly, not only when the second hour plate portion 2 is provided at the rear side of the first hour plate portion 1, but also overlaps the position of the vertical plane, or is provided at the front side thereof, it is possible to prevent the first hour plate portion 1 from being not visible due to the rotation of the second hour plate portion 2. Further, even when the second hour plate portion 2 rotates, since the indicator needle shaft is positioned inside the notched hole 2*a* at all times, the rotation of the second hour plate portion 2 is not prohibited by the indicator needle shaft.

In the second aspect of the invention, in the case of the configuration wherein in the first hour plate portion 1, the position provided with the indicator needle shaft insertion portion 1*a* is provided with the ring portion 1*b* formed in a ring shape, the third hour plate portion 3, which is rotatably provided with respect to the ring portion, is mounted on the inside of the ring portion 1*b*, the rotation center of the third hour plate portion 3 and the rotation center of the second hour plate portion 2 are provided at the same position (the center s), and the third hour plate portion 3 is configured to rotate coupled with the rotation of the second hour plate portion 2, the decoration is improved since the third hour plate portion 3 is further provided, and the trick-action effect may be further exhibited since the third hour plate portion 3 rotates coupled with the second hour plate portion 2.

In the third aspect of the invention, in the case of the configuration in which the first linkage gear plate 10 having the rotation center coincides with the center s of the first hour plate portion 1 and the second linkage gear plate 20 coaxial therewith are respectively provided rotatably, the center of the first linkage gear plate 10 is provided with the short cylindrical portion 11, the outside thereof is provided with the disk-like flange portion 12, the inner periphery of the short cylindrical portion 11 is provided with the inner gear 13, the outer periphery of the flange portion 12 is provided with the external gear 14 meshing with and coupled to the driving motor M, the outer periphery of the second linkage gear plate 20 is provided with the external gear 21, the third hour plate portion 3 is fixed to the center thereof so as to be rotatable together, the linkage gear 4 is provided so as to mesh with and be coupled to the inner gear 13 of the short cylindrical portion 11 and the external gear 21 of the second linkage gear plate 20, and the second hour plate portion 2 is fixed to the first linkage gear plate 10 so as to be rotatable together, the first linkage gear plate 10 rotates by the rotation of the driving motor M, thereby the second hour plate portion 2 is rotated, and the linkage gear 4 meshing with the inner gear 13 of the first linkage gear plate 10 and the second linkage gear plate 20 meshing therewith rotate, thereby obtaining a structure in which the third hour plate portion 3 rotates. In this case, when the number of the linkage gears 4 is set to be one (an odd number) or two (an even number), the second hour plate portion 2 and the third hour plate portion 3 may rotate together or rotate in the opposite directions.

DETAILED DESCRIPTION OF PREFERRED EMBODIMENTS

Figure 1:
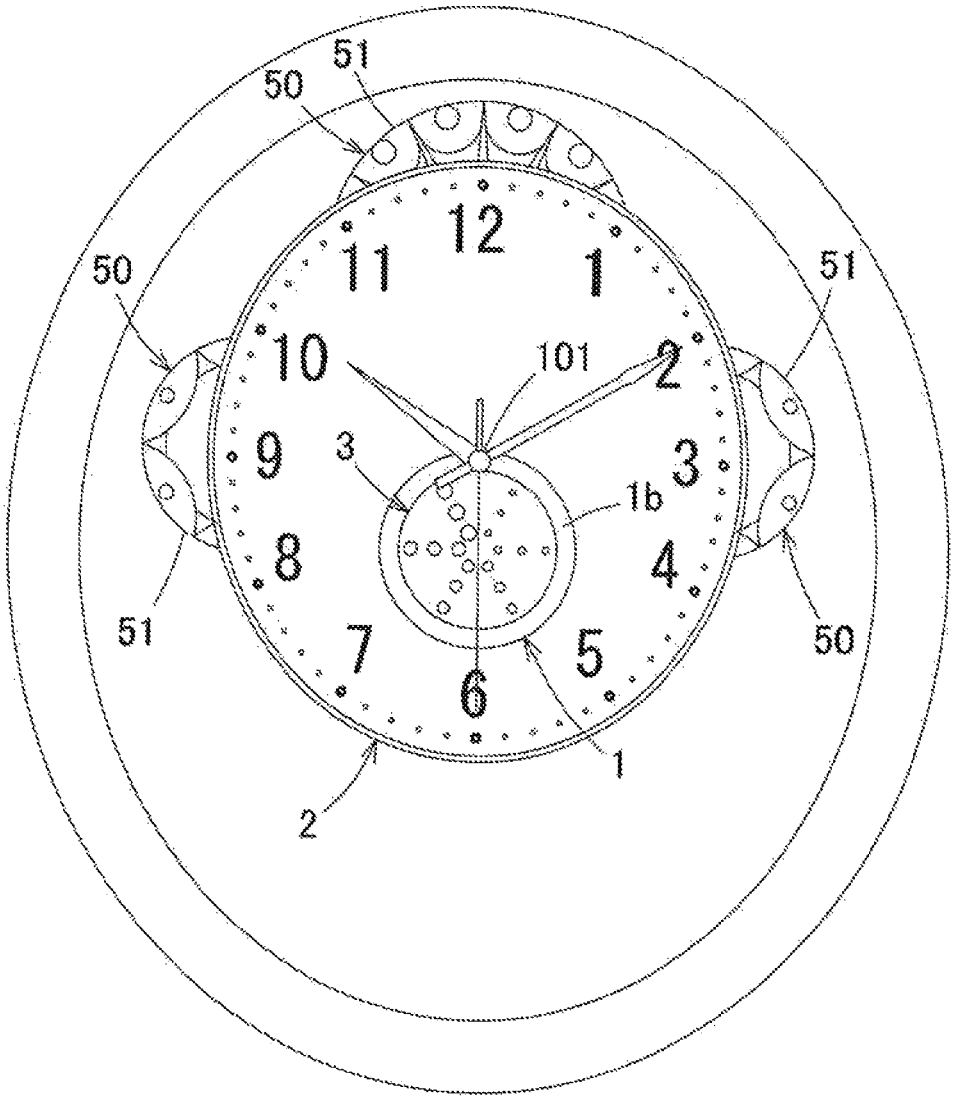
FIG. 1 is a front external appearance view illustrating a trick-action type clock according to an embodiment of the invention.
Figure 2:
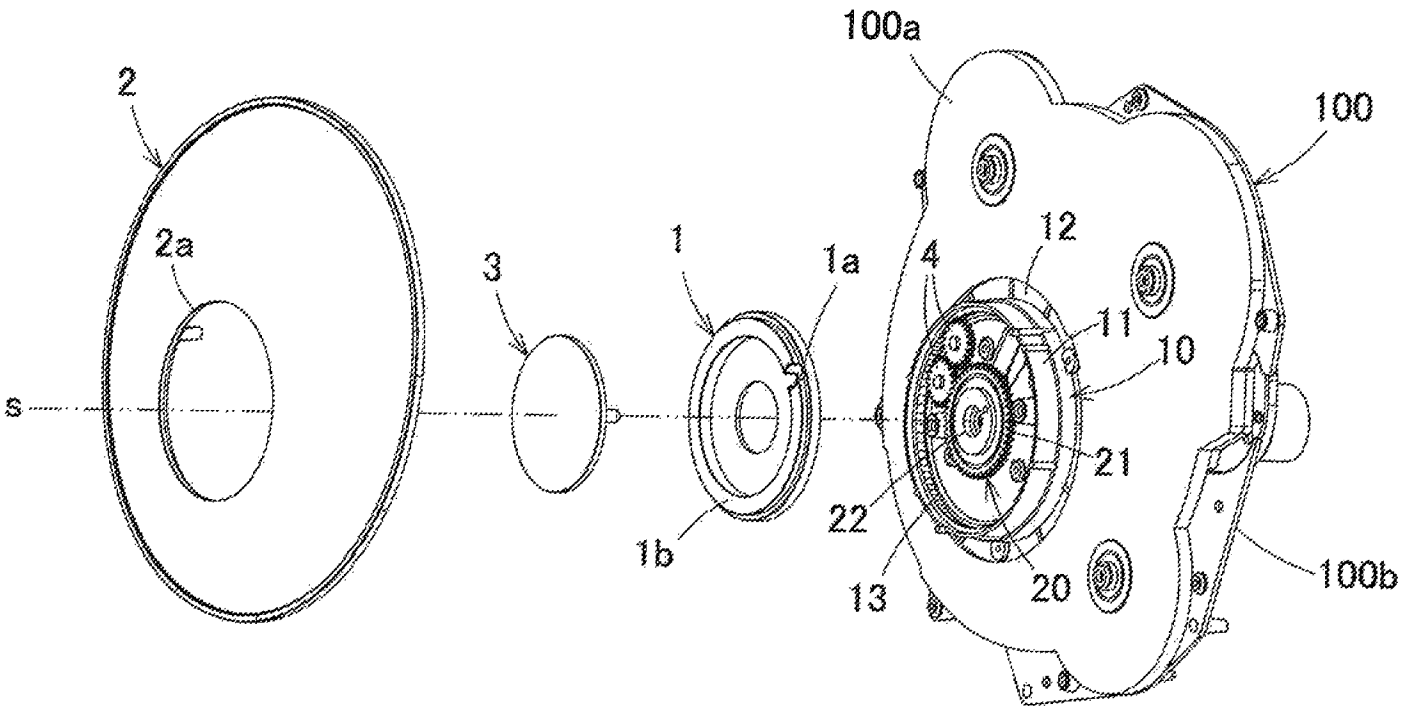
FIG. 2 is a perspective view illustrating a trick-action mechanism according to the embodiment of the invention.
Figure 3:
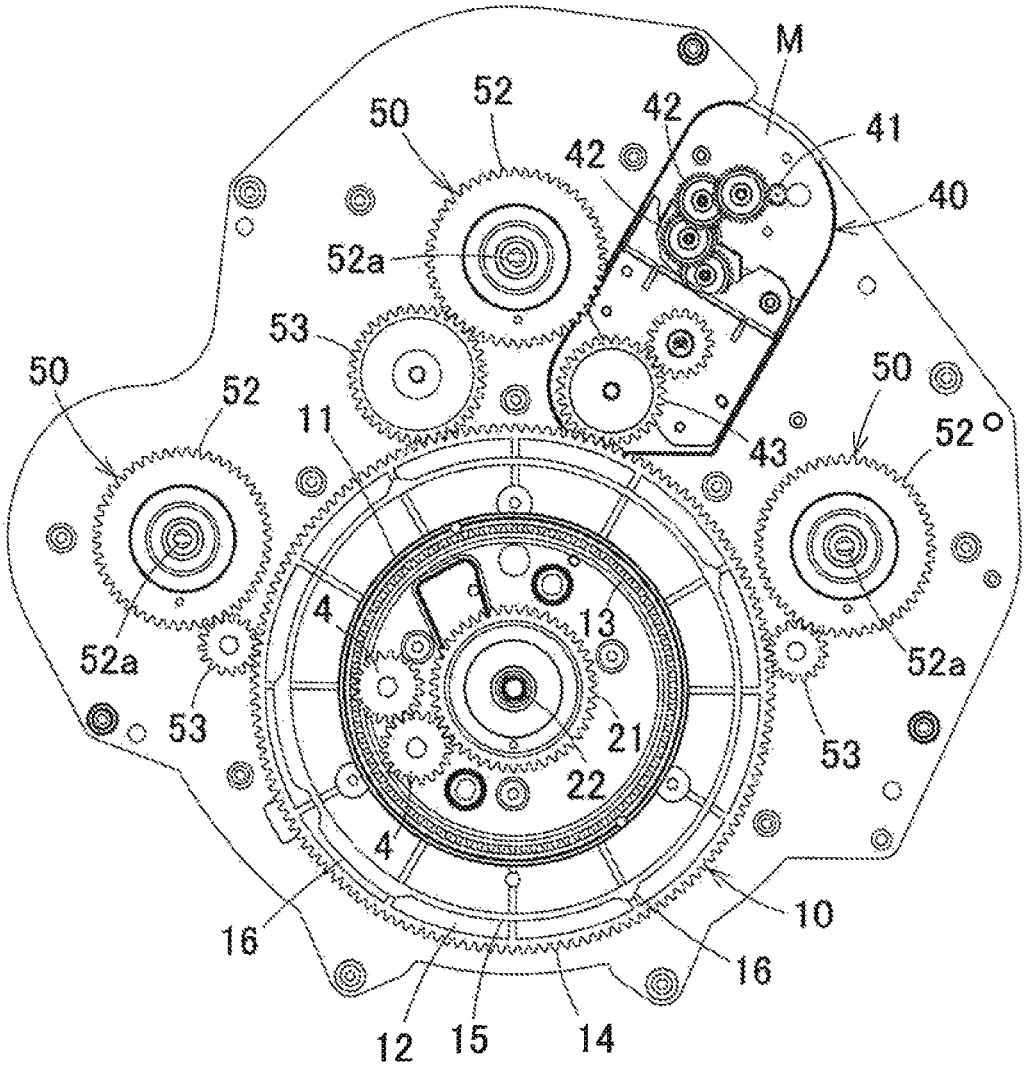
FIG. 3 is a front view illustrating the trick-action mechanism incorporated in a clock support plate according to the embodiment of the invention.
Figure 4:
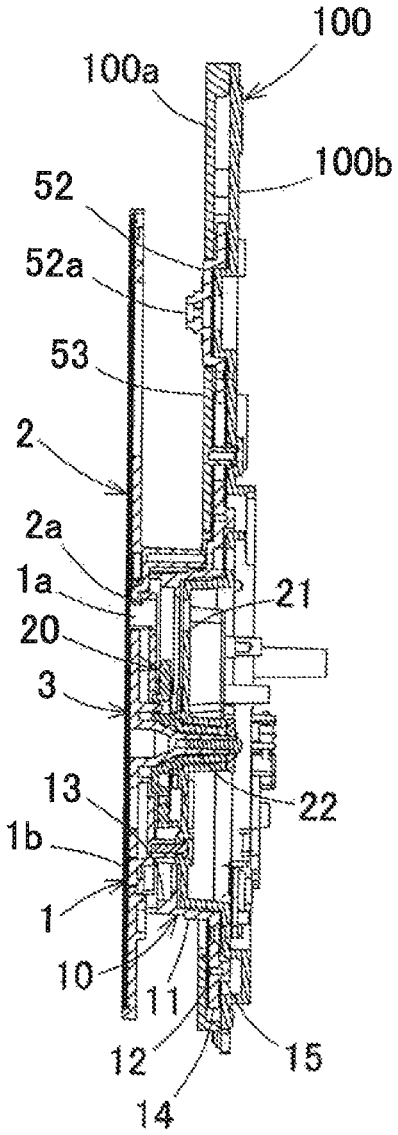
FIG. 4 is a longitudinal side view illustrating the trick-action mechanism according to the embodiment of the invention.
Figure 5:
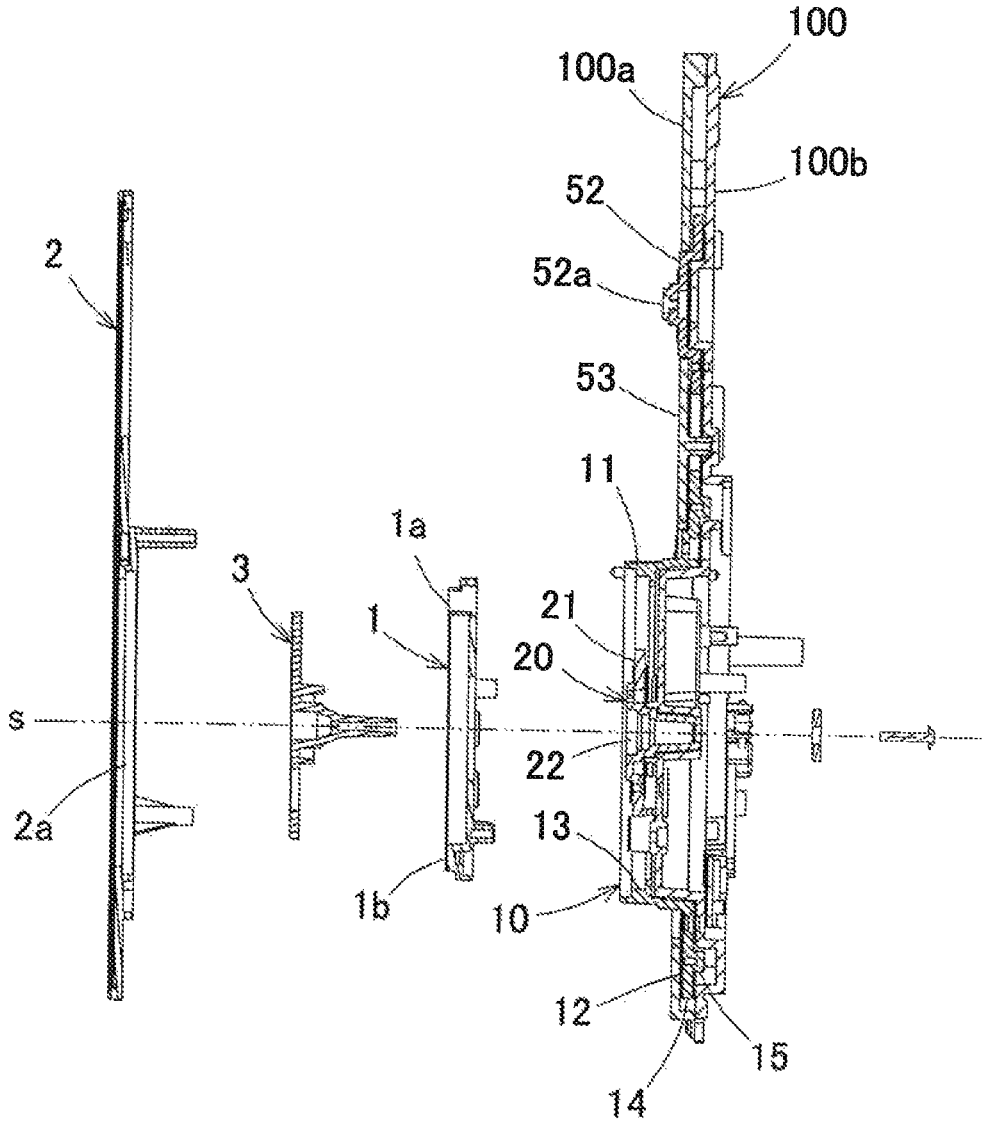
FIG. 5 is an exploded diagram of FIG. 4.
Figure 6:
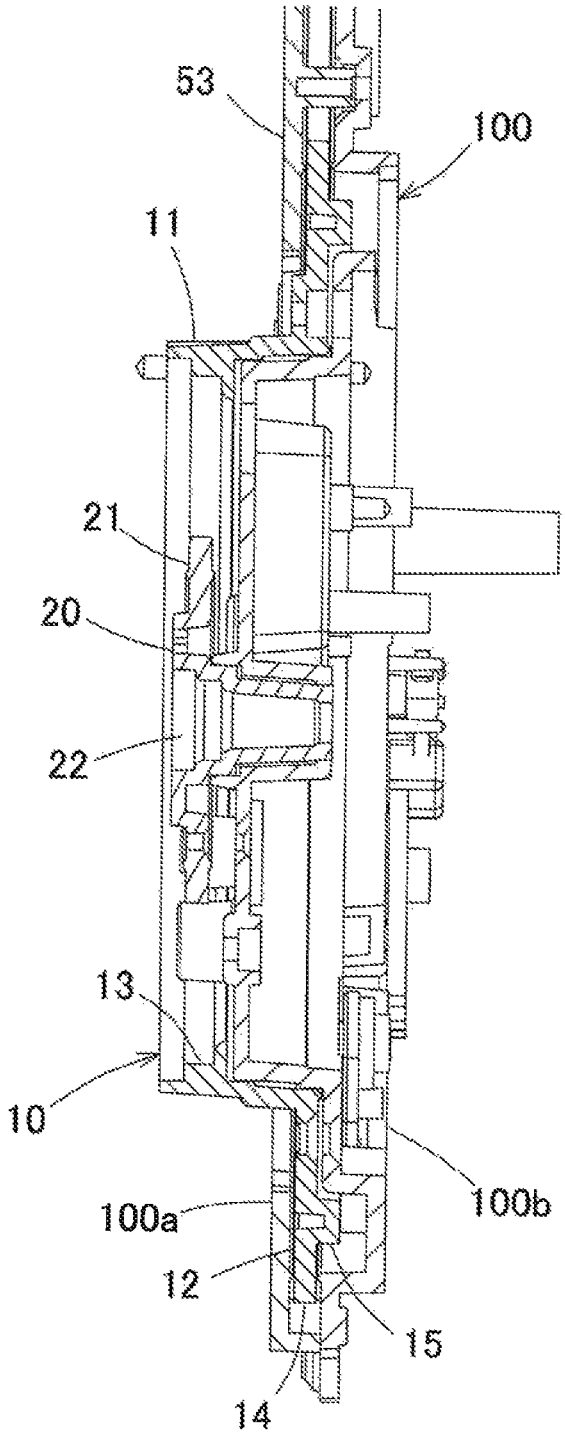
FIG. 6 is an enlarged view illustrating the clock support plate of FIG. 4.

Preferred embodiments of the invention will be described below with reference to the drawings. A trick-action structure of a clock of the embodiment basically includes a first hour plate portion 1 which is fixed to a clock support plate 100 (a front support plate 100*a* and a rear support plate 100*b*) and has a circular shape (with a center s) and a second hour plate portion 2 that is rotated by a driving motor M. Furthermore, in the case of the present embodiment, a third hour plate portion 3 to be described later is separately provided, and the third hour plate portion 3 is also provided to rotate.

The first hour plate portion 1 includes an indicator needle shaft insertion portion 1*a* which is provided at a position remote from the center s of the first hour plate portion 1 so that an indicator needle shaft 101 is inserted therethrough. Furthermore, the first hour plate portion 1 includes, in the case of the present embodiment, a ring portion 1*b* which is formed in a ring shape at the outer periphery thereof. Then, the indicator needle shaft insertion portion 1*a* is formed at the ring portion lb.

Furthermore, the third hour plate portion 3, which is rotatable with respect to the ring portion, is mounted on the inside of the ring portion 1*b*. The third hour plate portion 3 has a rotation center provided at a position (the center s) coincides with the rotation center of the second hour plate portion 2, and rotates coupled with the rotation of the second hour plate portion 2. Furthermore, in the front external appearance view of FIG. 1, since the third hour plate portion 3 is mounted on the inside of the first hour plate portion 1, only the ring portion 1*b* of the first hour plate portion 1 is visible from the outside.

Further, the second hour plate portion 2 has a rotation center provided at a position coincides with the center s of the first hour plate portion 1 in a circular shape, and includes a circular notched hole 2*a* which has the same shape as that of the first hour plate portion 1. Accordingly, the center of the circular shape of the notched hole 2*a* coincides with the center s of the first hour plate portion 1. As a result, even when the second hour plate portion 2 rotates, the first hour plate portion 1 is positioned to correspond to the notched hole 2*a* of the second hour plate portion 2 at all times.

Then, in the trick-action structure of this embodiment, a part of the hour plate (the second hour plate portion 2 and the third hour plate portion 3 of this example) rotates along the plane parallel to the clock support plate 100. Furthermore, in this embodiment, the circular notched hole 2*a*, which will be described later, of the second hour plate portion 2 is rotatably fitted to the outer peripheral edge of the first hour plate portion 1, and the first hour plate portion 1 and the second hour plate portion 2 are flush with each other (where the respective surfaces are provided at the same vertical plane).

In such a trick-action structure, for example, when the trick action starts on the hour, and the second hour plate portion 2 rotates, then the second hour plate portion 2 rotates about a rotation center different from that of the indicator needle shaft 101. For this reason, the rotation becomes an eccentric rotation with respect to the indicator needle shaft 101, so that the trick-action effect may be further exhibited.

Further, since the second hour plate portion 2 includes the circular notched hole 2*a* which corresponds to the first hour plate portion 1 and has a rotation center coincides with the center s of the first hour plate portion 1, even when the second hour plate portion 2 rotates, the first hour plate portion 1 is positioned to correspond to the notched hole 2*a* of the second hour plate portion 2 at all times.

With such a configuration, not only when the second hour plate portion 2 is provided at the rear side of the first hour plate portion 1, but also overlaps the position of the vertical plane thereof, or is provided at the front side thereof, it is possible to prevent the first hour plate portion 1 from being not visible due to the rotation of the second hour plate portion 2. Further, since the indicator needle shaft is positioned inside the notched hole 2*a* at all times, even when the second hour plate portion 2 rotates, the rotation of the second hour plate portion 2 is not prohibited by the indicator needle shaft 101.

Next, the rotation mechanism of the second hour plate portion 2 and the third hour plate portion 3 will be described.

A gear body serving as a first linkage gear plate 10 is provided at a position where the first hour plate portion 1 of the clock support plate 100 is provided. The first linkage gear plate 10 is provided so that the rotation center thereof coincides with the center s of the first hour plate portion 1.

The first linkage gear plate 10 is rotated by the driving motor M, and includes a short cylindrical portion 11 provided at the center thereof and a disk-like flange portion 12 is provided at the outside of the short cylindrical portion 11. Furthermore, an inner gear 13 is provided at the inner periphery of the short cylindrical portion 11, and an external gear 14 is provided at the outer periphery of the flange portion 12 so as to mesh with and be coupled to the driving motor M.

The flange portion 12 opposite to the short cylindrical portion 11 is provided with a ring shape cam portion 15 which protrudes toward the rear surface, and the outer peripheral of the cam portion 15 is provided with a protrusion 16 which protrudes in the radial direction with respect to the rotation axis. The protrusion 16 constitutes a detection mechanism of the rotation portion in the trick-action structure of this embodiment. A front end of a switch (not shown) provided at the detection mechanism comes into contact with the protrusion 16 to causes a trigger during a trick action, so that the rotation state of the first linkage gear plate 10 is detected, and the driving state of the driving motor M or the other mechanisms are controlled. Furthermore, the cam portion 15 shown in the drawing has a concave shape when seen from the front side thereof.

In the case of this embodiment, the driving motor M is mounted on a motor unit 40. The motor unit 40 transmits a driving force to an output gear 43 by meshing a reduction gear 42 with a gear 41 fixed to the driving motor M. The output gear 43 is fitted to the external gear 14 of the first linkage gear plate 10. Further, the second hour plate portion 2 is fixed to the first linkage gear plate 10 so as to rotate together.

Furthermore, a gear body serving as the second linkage gear plate 20 is rotatably provided at a position where the first hour plate portion 1 of the clock support plate 100 is provided so that the gear body is coaxial with the first linkage gear plate 10. The second linkage gear plate 20 includes an external gear 21 provided at the outer periphery thereof and a fixed portion 22 fixing the third hour plate portion 3 to the center thereof so as to rotate together.

Furthermore, a linkage gear 4 is rotatably provided in the clock support plate 100, the linkage gear being provided between the first linkage gear plate 10 and the second linkage gear plate 20 so that the inner gear 13 of the short cylindrical portion 11 meshes with and is linked to the external gear 21 of the second linkage gear plate 20.

In the trick-action structure of this embodiment as described above, when the driving motor M rotates, the first linkage gear plate 10 rotates, so that the second hour plate portion 2 fixed thereto rotates. Then, the linkage gear 4 meshing with the external gear 21 of the first linkage gear plate 10 and the second linkage gear plate 20 meshing therewith rotate, so that the third hour plate portion 3 rotates. The second hour plate portion 2 and the third hour plate portion 3 rotate in the same direction when the linkage gear 4 is provided in the odd number such as one, it rotates in the same direction, and when the linkage gears 4 are provided in the even number, they rotate in opposite directions mutually.

Furthermore, the trick-action structure of this embodiment is provided with a decorative rotation device 50 which rotates by meshing with and being coupled to the external gear 14 of the first linkage gear plate 10.

The decorative rotation device 50 includes a decorative rotation plate 51 which is rotatably provided in the clock support plate 100, a rotation gear 52 which attaches the decorative rotation plate 51 to a center attachment hole 52*a*, and a linkage gear 53 which links the rotation gear 52 and the external gear 14 of the first linkage gear plate 10 to each other.

In the embodiment, three sets of decorative rotation devices 50 are provided in total in the hour plate of the clock, where one set of decorative rotation device is provided at the upper portion of the front surface and the other two sets of decorative rotation devices are provided in the directions of three o'clock and nine o'clock, respectively.

Figure 7:
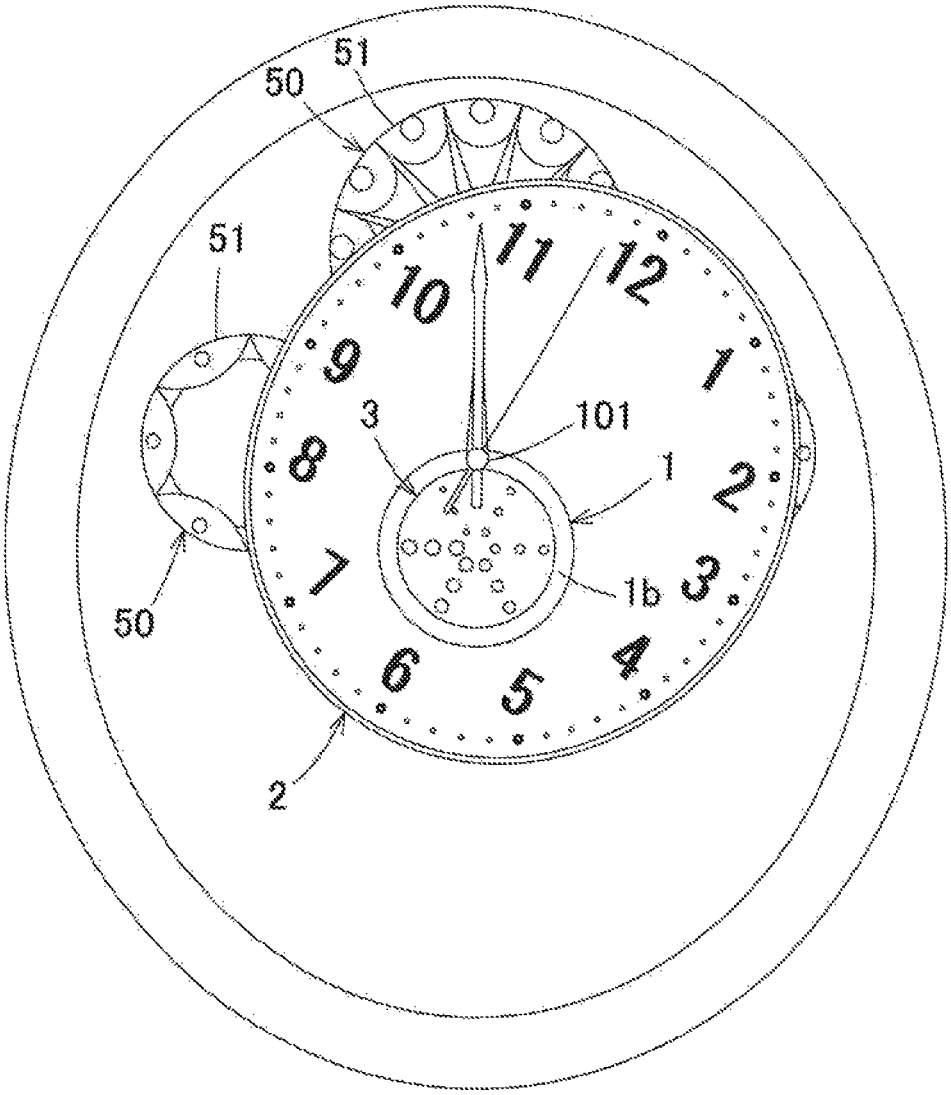
FIG. 7 is a front view illustrating a state where a second hour plate portion and a third hour plate portion according to the embodiment of the invention, rotate.
Figure 8:
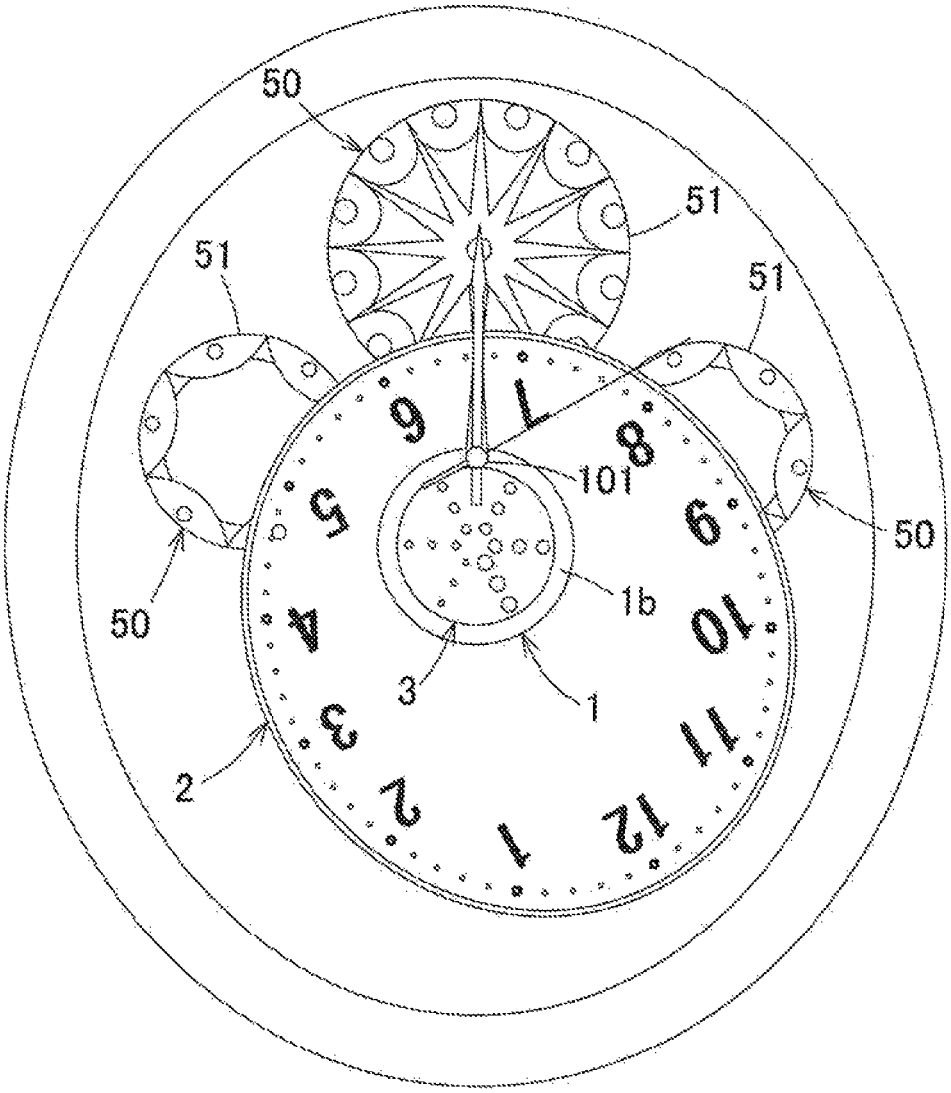
FIG. 8 is a front view illustrating a state where the second hour plate portion and the third hour plate portion according to the embodiment of the invention, rotate.
Figure 9:
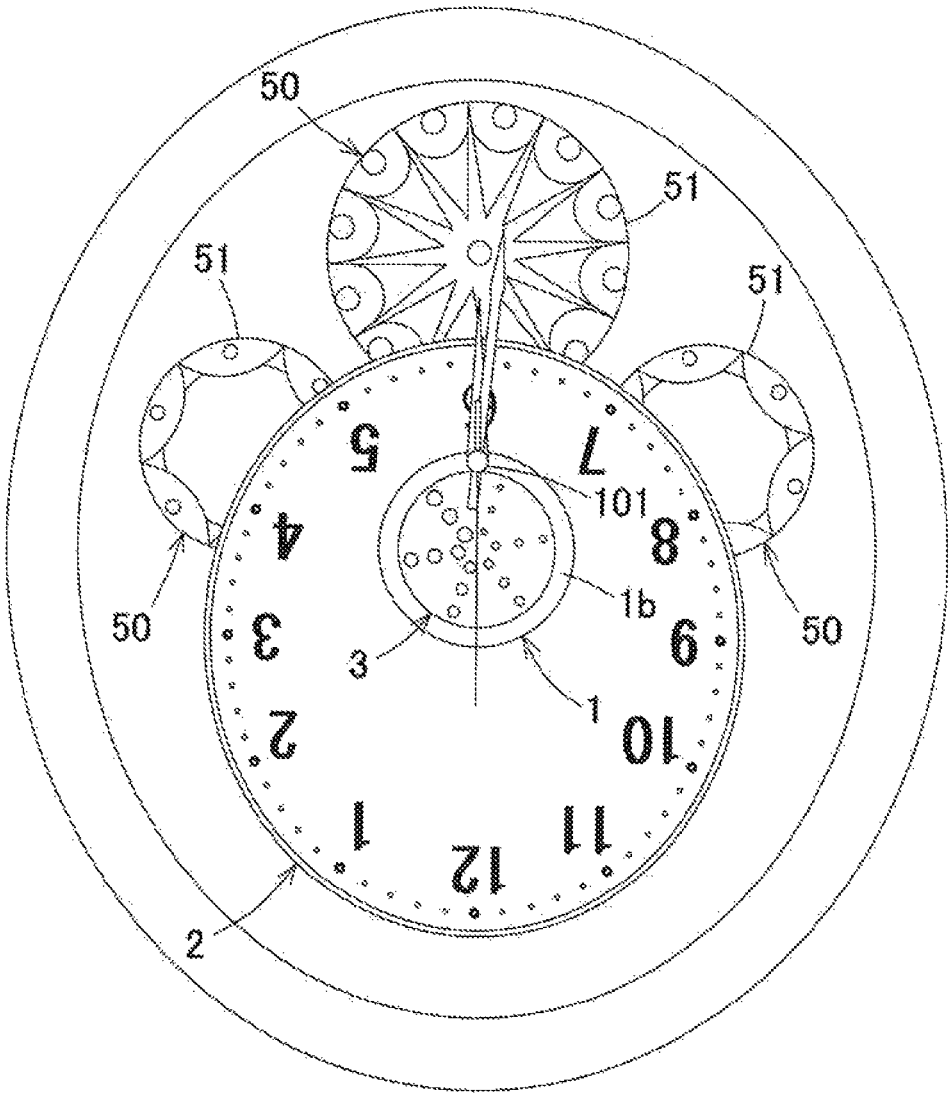
FIG. 9 is a front view illustrating a state where the second hour plate portion and the third hour plate portion according to the embodiment of the invention, rotate.

In the trick-action structure of this embodiment, when the driving motor M rotates in response to a driving signal transmitted from a control unit (not shown) on the hour, as described above, the first linkage gear plate 10 rotates, so that the second hour plate portion 2 fixed thereto rotates, the third hour plate portion 3 rotates, the decorative rotation device 50 is operated, and then the decorative rotation plate 51 rotates (see FIGS. 7 to 9).

Furthermore, the rotation of the second hour plate portion 2 may be appropriately adopted as an operation in which the second hour plate portion continuous rotates from the position of 180° shown in FIG. 9 so as to return to the original position, an operation in which the second hour plate portion reversely rotates from the current position so as to return to the original position, an operation in which the second hour plate portion normally and reversely rotates by an appropriate angle so as to be operated in the clockwise direction or the counter-clockwise direction, and the like.

The trick-action type clock of the invention is excellent in saving power of the number of components, and in exhibiting the trick-action effect. The trick-action type clock of the invention may be appropriately used in a general clock such as a wall clock.

What is claimed is:

1. A trick-action type clock, comprising:

a clock support plate;

a first hour plate portion fixed to the clock support plate and having a circular shape, said first hour plate portion including an indicator needle shaft insertion portion provided at a position away from a center of the first hour plate portion;

a time indicator having an indicator needle shaft inserted into the indicator needle shaft insertion portion; and a second hour plate portion to be rotated by a driving motor, said second hour plate portion including a circular notched hole having a rotation center aligned with the center of the first hour plate portion, said circular notched hole having a shape the same as that of the first hour plate portion.

2. The trick-action type clock according to claim 1, wherein said first hour plate portion further includes a ring portion formed in a ring shape, said indicator needle shaft insertion portion being formed in the ring portion.

3. The trick-action type clock according to claim 2, further comprising a third hour plate portion arranged to be rotatable with respect to the ring portion, said third hour plate being disposed inside the ring portion, said third hour plate portion having a rotation center at a position the same as that of the rotation center of the second hour plate portion, said third hour plate portion being arranged to rotate coupled with the second hour plate portion.

4. The trick-action type clock according to claim 3, further comprising a first linkage gear plate and a second linkage gear plate both attached to the clock support plate to be rotatable, said first linkage gear plate having a rotation center aligned with the center of the first hour plate portion, said second linkage gear plate being arranged coaxially with the first linkage gear plate.

5. The trick-action type clock according to claim 4, wherein said first linkage gear plate is arranged to be rotated by a driving motor, said first linkage gear plate including a short cylindrical portion at the center thereof, a flange portion with a circular plate shape disposed outside the short cylindrical portion, an inner gear disposed at an inner periphery of the short cylindrical portion, and a first external gear to be connected to the driving motor at an outer periphery of the flange portion.

6. The trick-action type clock according to claim 5, wherein said second linkage gear plate includes a second external gear at an outer periphery thereof, and a fixed portion at a center thereof for fixing the third hour plate portion to be rotatable together, said clock support plate including a linkage gear for engaging with the inner gear of the first linkage gear plate and the second external gear of the second linkage gear plate.

7. The trick-action type clock according to claim 6, wherein said the second hour plate portion is fixed to the first linkage gear plate to be rotatable together, said linkage gear engaging with the inner gear of the first linkage gear plate and the second linkage gear plate engaging with the linkage gear being arranged to rotate so that the third hour plate portion rotates when the first linkage gear plate is rotated by the driving motor so that the second hour plate portion rotates.

* * * * *